US005975152A

United States Patent [19]

Kluge

[11] Patent Number: 5,975,152

[45] Date of Patent: Nov. 2, 1999

[54] FLUID CONTAINER FILLING APPARATUS

[75] Inventor: Douglas J. Kluge, Clearwater, Minn.

[73] Assignee: Pump Tec, Inc., Anoka, Minn.

[21] Appl. No.: 09/087,009

[22] Filed: May 29, 1998

[51] Int. Cl.[6] ..... B65B 31/00

[52] U.S. Cl. ..... 141/20; 141/113; 141/18

[58] Field of Search ..... 141/2–4, 18, 20, 141/21, 25–28, 369, 370, 113

[56] References Cited

U.S. PATENT DOCUMENTS

| | | | |
|---|---|---|---|
| 2,684,805 | 7/1954 | McBean | 141/3 |
| 2,914,096 | 11/1959 | Foresman, Jr. | 141/20 |
| 3,055,402 | 9/1962 | Schofield | 141/20 |
| 3,211,191 | 10/1965 | Honisch | 141/20 |
| 3,642,035 | 2/1972 | Marand | 141/20 |
| 3,995,666 | 12/1976 | Michaels | 141/3 |
| 4,321,953 | 3/1982 | Grothoff | 141/2 |
| 5,673,731 | 10/1997 | Green et al. | 141/18 |

*Primary Examiner*—J. Casimer Jacyna
*Attorney, Agent, or Firm*—Roger W. Jensen

[57] ABSTRACT

A portable, manually operated apparatus for filling fluid into a fluid container, the container having a check-valve port for discharging fluid and for receiving fluid. A base member has first and second spaced-apart bores, and a third bore connecting the first two bores. A manifold has fluid supply and return passages connected respectively to the first and second bores. A fluid pump connected to the manifold supply and return passages is adapted, when actuated, to supply fluid under pressure to the fluid supply passage.

30 Claims, 7 Drawing Sheets

FIG. 6A
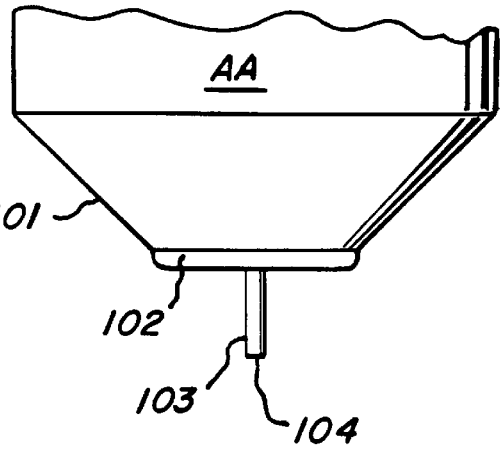
FIG. 5
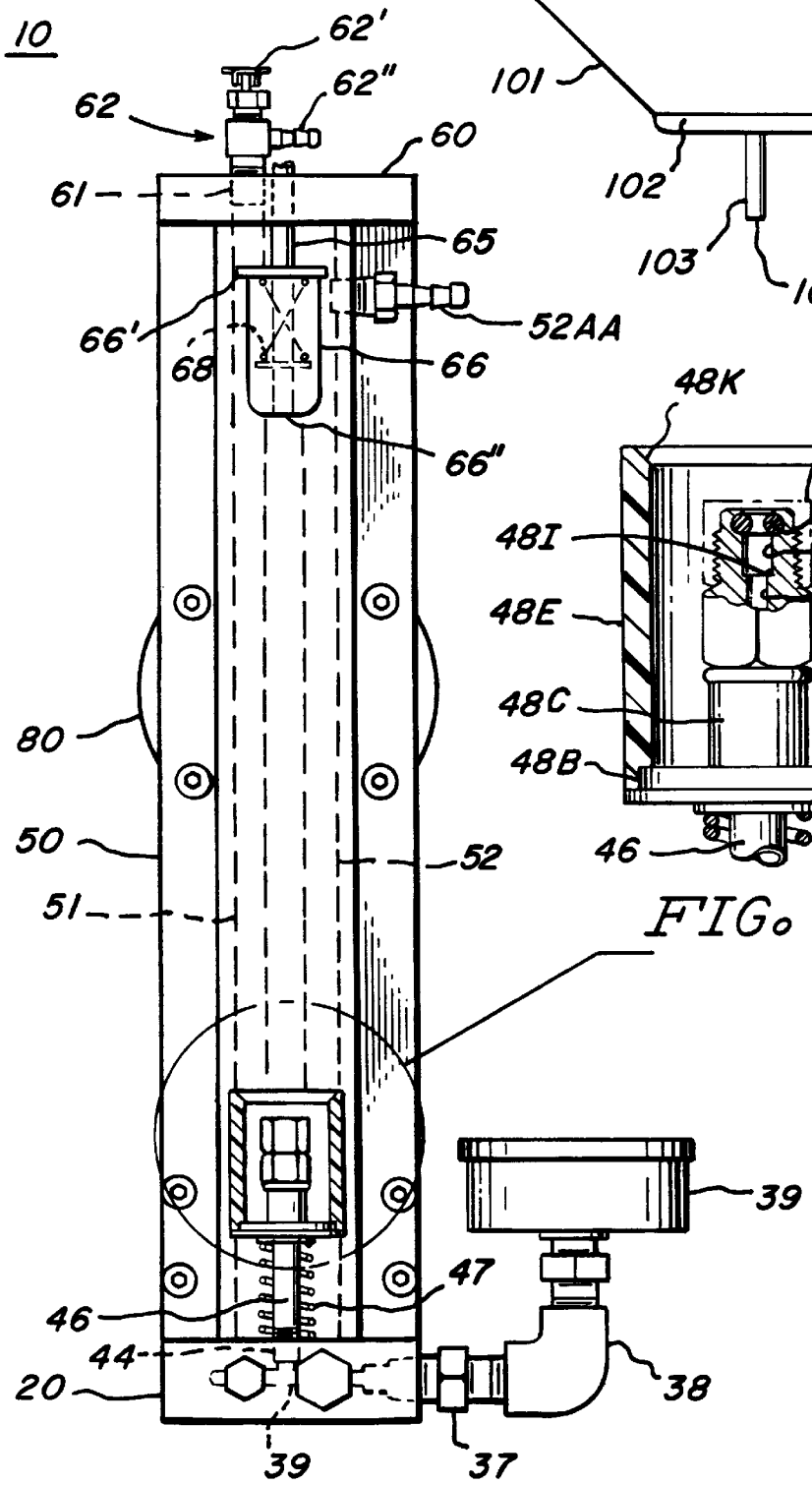
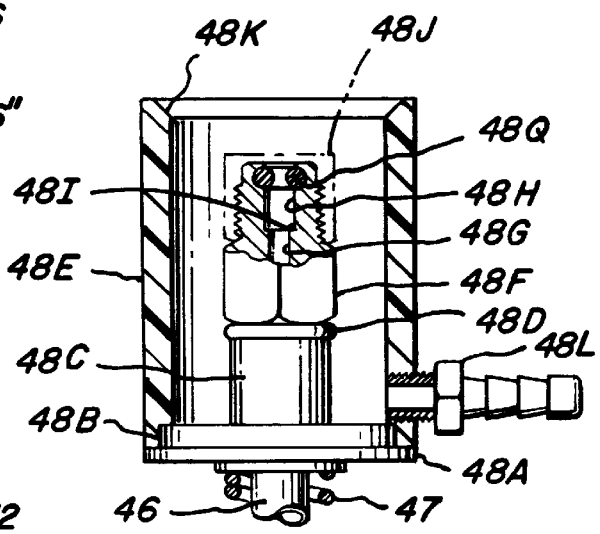
FIG. 6

FIG. 9
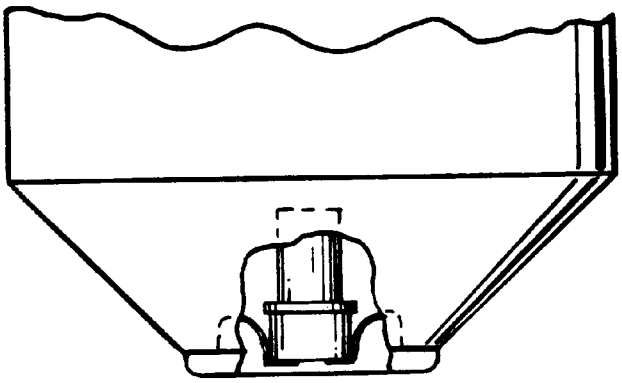
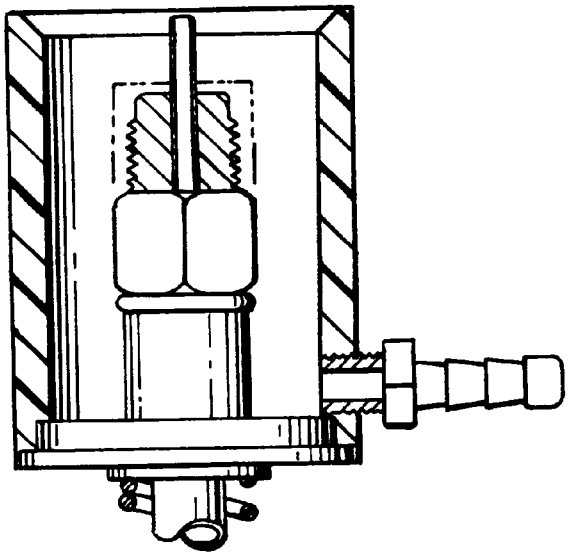
FIG. 10

FLUID CONTAINER FILLING APPARATUS

BACKGROUND OF THE INVENTION

I. Field of the Invention

The subject invention relates broadly to the field of apparatus for filling and/or transferring fluid into a fluid container. The preferred embodiment of the invention is a portable, manually-operated apparatus for filling fluid into a pressurized fluid container (such as an aerosol can) wherein the fluid container has a "check-valve" type port means which when actuated permits the discharge of fluid under pressure from the container. However, the invention may be used in other applications and fields such as (i) reverse osmosis equipment and (ii) hydrostatic testing.

II. Discussion of the Prior Art

There are, of course, many prior art machines and systems for transferring fluid to a fluid container. The field of pressurized fluid containers is more specific and, of course, pressurized containers such as aerosol cans have been used on a world-wide basis for a number of decades. There are many diverse products supplied in aerosol cans and the manufacture of such cans and the filling thereof is highly developed.

SUMMARY OF THE INVENTION

The present invention provides an apparatus which, in one application, permits the refilling of aerosol cans once the original contents have been utilized or used. The present invention may be configured in a relatively small, light-weight (and hence portable) machine that would typically be operated using manual cranking motion, i.e., without the use of an electric motor or equivalent powered torque producing means for rotating the fluid pump means.

In summary, the present invention provides a base member having first and second spaced apart bores and a third bore at an angle to and connecting the first and second bores. The present invention further includes a manifold means having fluid supply and return passages therein, the manifold means being connected to the base member with the supply and return passages thereof respectively connected to said first and second bores. A fluid pump means is adapted to be connected to a supply of fluid (for transfer into one or more containers). The pump means is connected to the manifold means and is adapted, when actuated, to supply fluid under pressure to the fluid supply passage of the manifold means. Finally, the invention includes receiving means adapted to receive a port means of a container to be filled, the receiving means also being connected to the third bore of the base member to receive fluid under pressure.

The invention may include means for manual actuation of the fluid pump means. The receiving means further may include means which, in combination with container port or valve means, causes the opening of said container valve means upon insertion of the container into the receiving means so as to permit fluid flow from the fluid pump means via the fluid supply passage and the first and third bores into the container.

The invention may further include means for selectively controlling the pressure of the fluid applied to the container independent of the pressure of the fluid supplied by the fluid pump means to the fluid supply passage. In the preferred embodiment of the invention, the aforesaid pressure control means includes a pressure regulator means positioned in the second bore.

Means are shown and described for refilling both types of aerosol containers, i.e., both male and female-type port means.

BRIEF DESCRIPTION OF THE DRAWINGS

FIG. 5 is a side view of the filling apparatus;

FIG. 6 is an enlargement showing further detail of the receiving means depicted in FIG. 5;

FIG. 6*a* is a partial depiction of an aerosol can having a male-type port adapted to co-act with the receiving means shown in FIG. 6;

FIG. 9 is a partial depiction of an aerosol can having a female-type port; and FIG. 10 is a male-type receiving means for use with the can shown in FIG. 9.

DETAILED DESCRIPTION OF THE INVENTION

Figure 1:
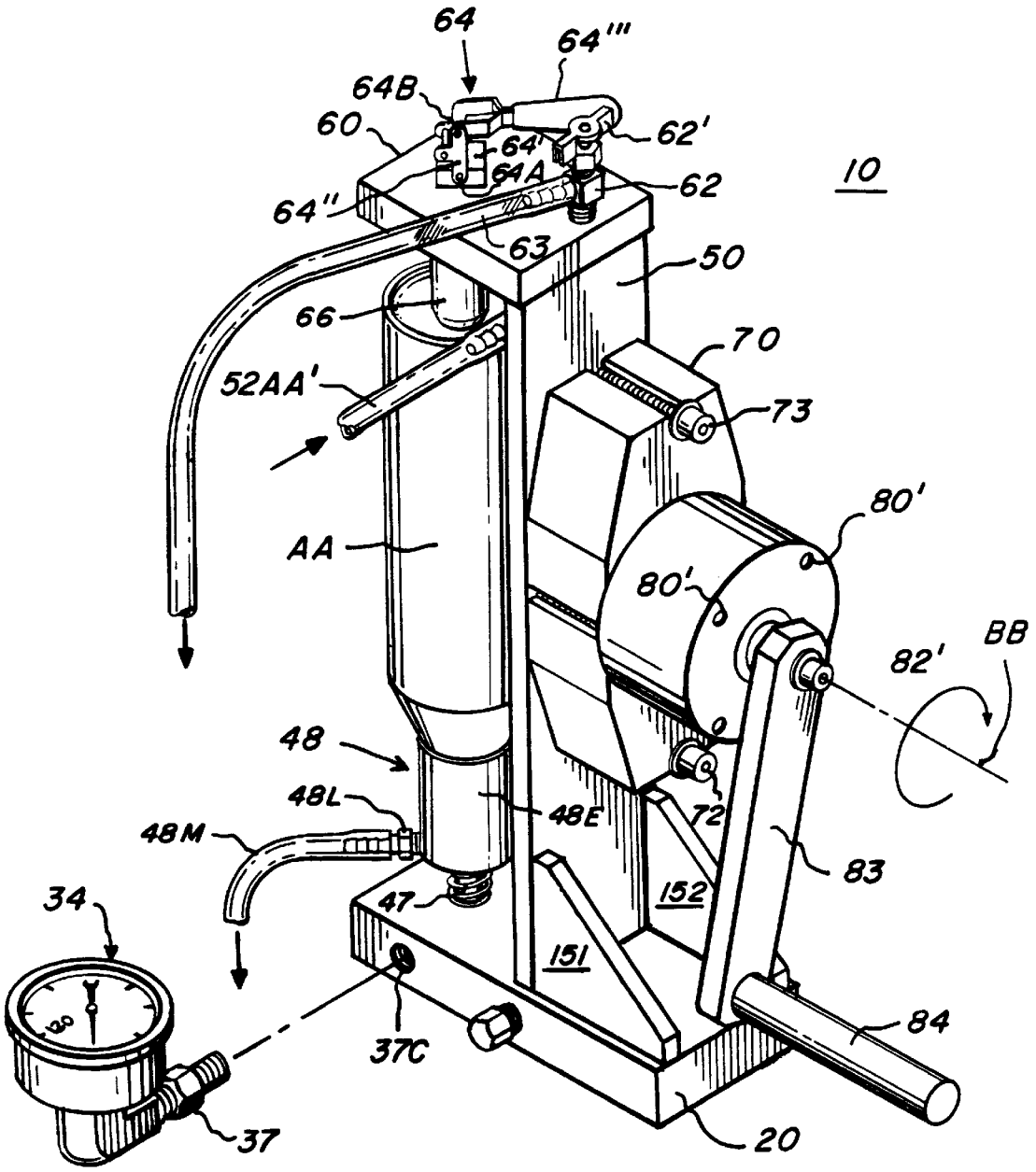
FIG. 1 is an isometric view of the preferred embodiment of the invention.

Referring to FIG. 1, the reference numeral 10 designates a portable, manually operated apparatus for filling or transferring fluid into a fluid container AA. In broad terms, the apparatus comprises a base member 20, a manifold means 50, a fluid pump means 70 and a receiving means 48.

The base means 20 is shown in its normal horizontal position. The manifold 50 is rigidly connected to the base means 20 by suitable means including brackets or buttresses 151 and 152, machine screws 151' and 152' (FIG. 4) connecting the brackets 151 and 152 to the base, respectively, and screw means 153 and 154 connecting the manifold to the brackets 151 and 152. A top housing member 60 is attached using suitable means to the top of the manifold 50.

The manifold means 50 has a pair of bores or passageways 51 (supply) and 52 (return) extending, parallel to one another, from the top to the bottom of the manifold. Manifold 50, in the preferred embodiment, is an extrusion of aluminum. Return passageway 52 is connected to a supply of fluid to be pumped (not shown) by a fitting 52AA to which is attached a tube or conduit means 52AA'.

The pump 70, in the preferred embodiment, is a double-acting simplex plunger pump such as is shown in the James E. Cook, U.S. Pat. No. 5,173,039 and in the James E. Cook, et al., U.S. Pat. No. 5,183,396, the specific details of which are incorporated by reference herein.

Figure 2:
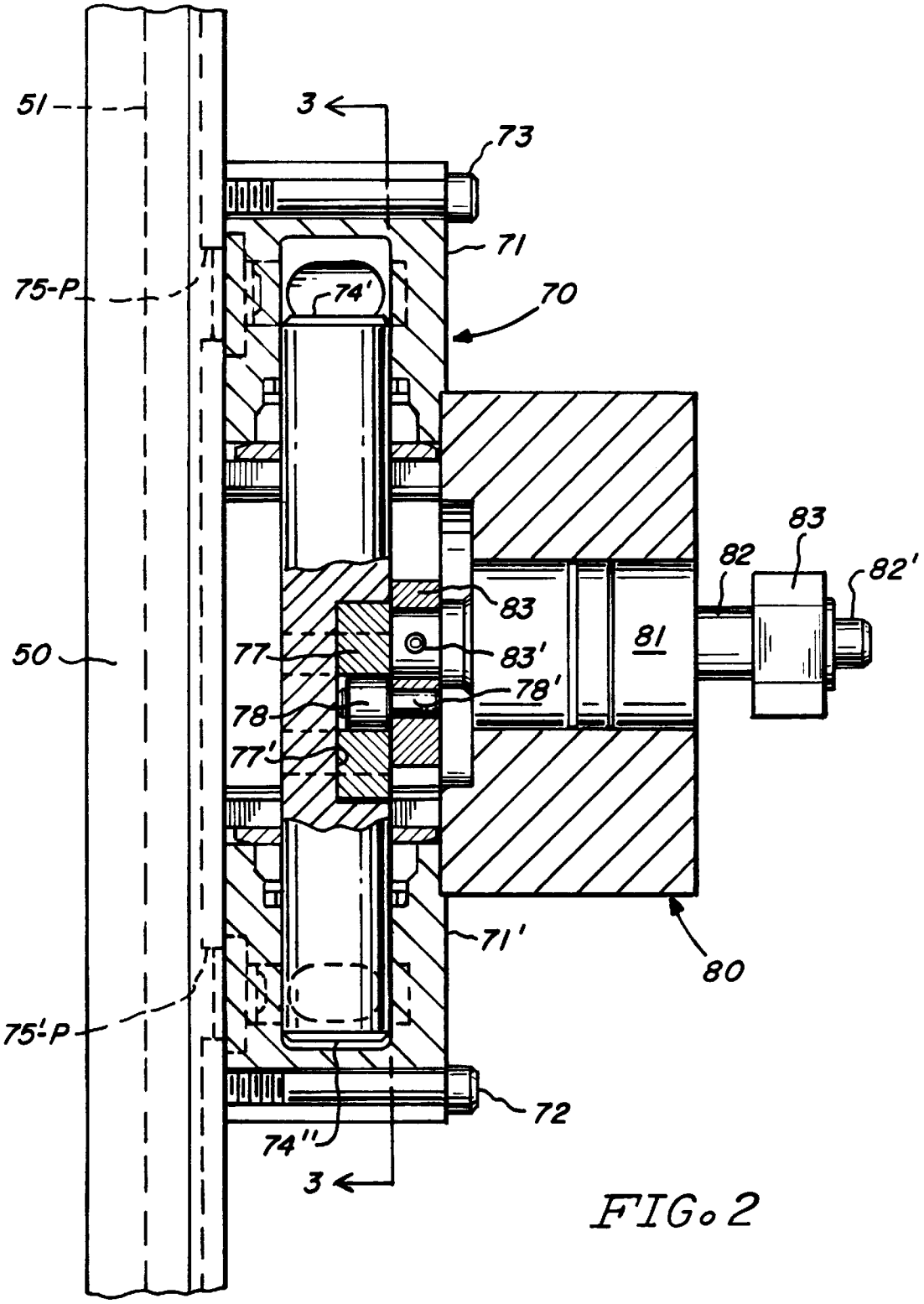
FIG. 2 is a cross-section of a fluid pump means attached to a manifold means as viewed along section lines 2—2 of FIG. 3.
Figure 3:
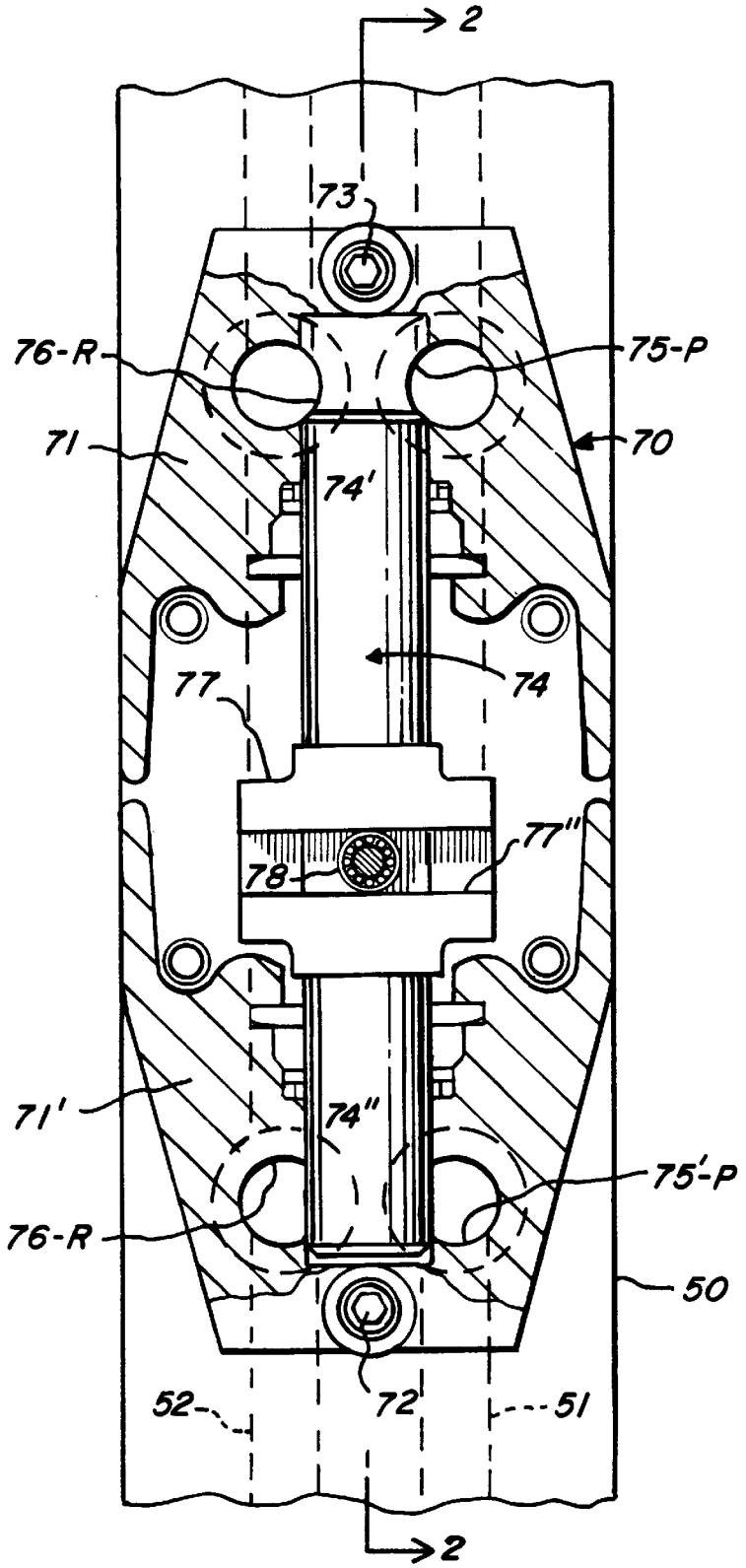
FIG. 3 is a view of the pump of FIG. 2 as viewed along section lines 3—3 thereof.

The pump 70 is shown in considerable detail in FIGS. 2 and 3, and comprises in part a plunger 74 which corresponds to plunger 70 shown in the aforesaid '039 patent. The pump 70 further includes a pair of housings 71 and 71' held in position with respect to the manifold 50 by suitable attachment means including 72 and 73. Outlet pressure ports 75-p and 75'-p in housings 71 and 71' are in communication with supply passageway 51, fluid pumped by the reciprocation of plunger 74 is pumped via 75-p and 75'-p into the pressure passageway 51. Return ports 76-r and 76'-r are also provided in the housing 71–71' respectively, and are in communication with the return passage 52 in the manifold 70.

A cam follower 77 is mounted in a suitable centrally located recess 77' of plunger 74 and has a slot 77" for receiving a journaled wheel 78, rotatably mounted on the end of a shaft 78' which is carried by wheel 83 pinned to shaft 82 by a pin 83', shaft 82 being journaled in a bearing 81 centrally positioned in a bearing housing 80 which is fastened to the pump 70 by suitable means 80' (see FIG. 1). Rotational shaft 82 has a reduced end 82' for receiving one end of a crank arm 83, the other end of which is connected to a crank 84 as shown in FIG. 1. Crank 83 is secured by suitable means to shaft 82 so that rotation of the crank arm 83 by manual rotation of the handle 84 causes rotation of the shaft about an axis which is identified in FIG. 1 by reference BB. It will be further understood that such rotation of shaft 82 will cause the eccentric or cam means 78 to cause the piston 74 to reciprocate back and forth, the slot 77" permitting the necessary transverse movement of the eccentric 78 in its engagement with the follower 77. The plunger or piston 74 is shown in FIG. 3 in its lowermost position; at the other extreme, end 74' of the piston 74 will be adjacent to the end of the cylinder in which it reciprocates all as is taught in the aforesaid patent '039.

In sum, the pump 70 when operated by the crank means 83/84, functions to supply fluid under pressure into the supply or pressure passageway 51 of manifold 50.

Figure 4:
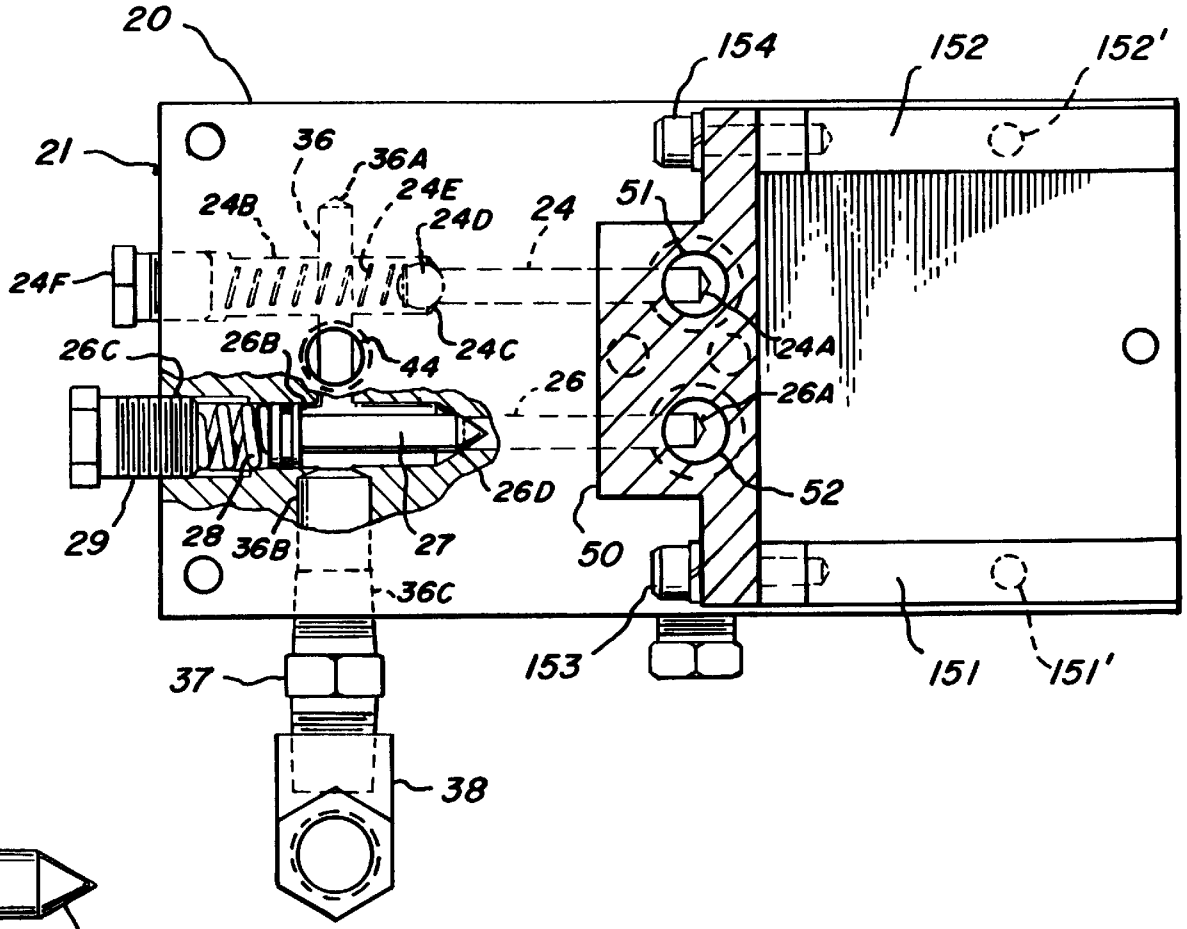
FIG. 4 is a view of a base member having connected thereto one end of the manifold member as viewed along section lines 4—4 of FIG. 8.
Figure 4A:
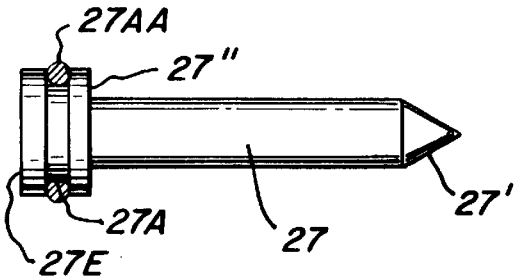
FIG. 4*a* is an enlarged view of a piston used in the pressure regulator apparatus shown in FIG. 4.
Figure 7:
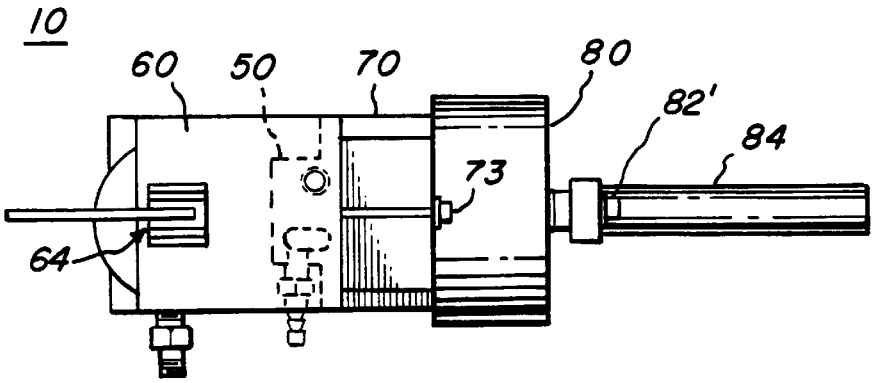
FIG. 7 is a top view of the apparatus.
Figure 8:
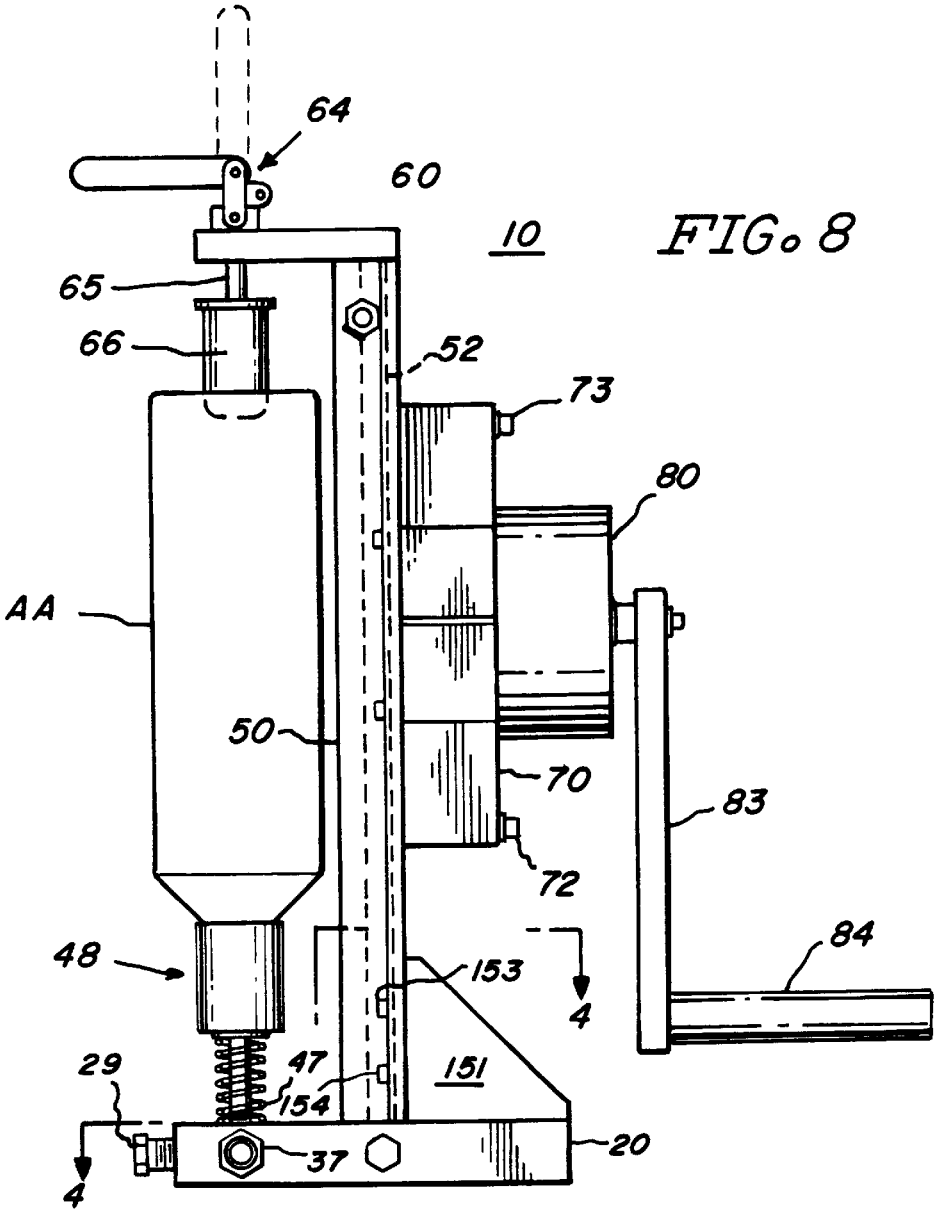
FIG. 8 is a side view of the apparatus.

Referring now to FIGS. 4 and 5, it will be noted that the manifold means 50 is positioned on the base member or base means 20 so that the fluid supply or pressure passage 51 and the return passage 52 are in register respectively with the ends 24A and 26A of first and second spaced apart bores 24 and 26, which are best shown in FIG. 4, and which extend in spaced apart, parallel relationship horizontally through the base. A third bore 36 is provided in the base member; it is at an angle (preferably at a right angle) to bores 24 and 26. One of the functions of bore 36 is to provide a connection between bores 24 and 26; a second function is to provide a means for connecting a pressure gauge means 39. Thus, in broad terms a fluid path may be traced from pressure passageway 51 in manifold 50 through first bore 24, third bore 36 and second bore 26 back to the return passageway 52 of the manifold.

The first bore 24 has an enlarged diameter 24B adjacent to end 21 of base 20, the junction between the two sections of the bore being identified by reference numeral 24C which provides a seat for a ball check means comprising a ball 24D biased against the seat by spring 24E, one end of which is in contact with 24D and the other end of which is in contact with a plug means 24F. Ball check means 24D functions to permit fluid-flow in bore 24 to the left as is shown in FIG. 4, but not to the right.

Referring again to FIG. 4, the second bore 26 has an enlarged portion 26B adjacent to end 21 of base 20, a valve seat surface 26D being defined between the two sections of the bore. To the left of the valve seat 26D is a pressure regulator apparatus including a piston 27 having a conical end 27' at the right end as shown in FIG. 4 and adapted to co-act with valve seat surface 26D. The left end of piston 27 has an enlarged head portion thus defining a piston surface 27" and the left end or face of the piston 27 is identified by reference numeral 27E. The head of the piston 27 has a groove 27A in which is positioned a suitable gasket 27AA having a piston ring function, i.e., the head of the piston 27 being snugly positioned within bore 26B. A spring means 28 is positioned in the bore 26, one end of which abuts the surface 27E and the other end of which is abutted against the end of a adjustable screw means 29 screwed into a threaded portion 26C at the left end of bore 26B. The function of piston 27 will be described further below but it should be understood that the piston 27 and its associated apparatus provide a pressure regulator function.

The receiving means 48 is best shown in FIGS. 5 and 6; it comprises a pipe member 46 positioned in a short threaded bore 44 in base 20, the bore 44 being in the top surface of base 22 and in register with the third bore 36 as is shown in FIG. 4.

A female-type receiving means is shown in cross section in FIG. 6; it comprises a cylindrically shaped member 48F, attached to the top of the pipe 46; it has a first small diameter bore 48G and, near the top thereof as shown in FIG. 6, a larger diameter bore 48H, a step 48I being defined between the two bores 48G and 48H. At the top of bore 48H is a rubber O-ring or the like 48Q, which is held in position by a nut 48J.

The receiving means further includes a multifunction cup 48E, the top open and beveled end of which is identified by reference numeral 48K and the bottom of which sits on a stepped support formed by a circular member 48A and a reduced diameter portion 48B thereof, both of which are provided with a central opening sized so as to permit free vertical motion thereof with respect to the pipe 46. A biasing spring 47 positioned between the underside of plate 48A and the top of base 20 functions to bias member 48A/48B/container 48E upwardly as shown in FIG. 5. A fitting 48L is attached near the bottom of cup 48E to provide a means for draining excess fluid through a suitable tube means 48M (see FIG. 1) back to the supply tank of fluid (not shown).

FIG. 6A shows the top portion of a typical aerosol can having a male-type spout for dispensing pressurized fluid contained within the tank; those skilled in the art will understand that the standard aerosol can of this type has a valve within, adapted to be operated by the male spout being pushed inwardly. Thus in FIG. 6A, reference letters AA identify the can and top thereof has a shoulder 101 which necks down to a central top ring 102, in the center of which is the aforementioned male spout 103, the end or tip of which is identified numeral 104.

In operation, the can AA would be positioned so that the surface 101 thereof is in engagement with the surface 48K of the cup 48E, and the spout 103 would be inserted into the bore 48H, the spout 103 passing through the O-ring 48Q.

The top member 60 attached to manifold 50 provides two functions. First to mount a petcock valve 62 which is adapted to be threaded into a threaded bore 61 which is in communication with the fluid supply passage 51 and has valve means (not shown) operated by a petcock handle 62'; to facilitate venting air at start up, the valve 62 further includes a stem 62" to which may be connected a tube 63 for said venting. The second function of the top member 60 is to provide a support for one of the elements of the can holding means. More specifically, the top member 60 has a bore therethrough through which freely extends a rod 65 which passes also through a central aperture or bore in a square-shaped plate 64' which is one of the components of an overcenter clamp which is generally designated in FIG. 1 by the reference numeral 64. The top of the rod 65 is connected to one end of a lever 64'" which is connected by a pivot 64B to an intermediate linkage 64" which in turn is pivotally connected to plate 64' by pivot means 64A. Thus, when arm 64'" is in one position, the rod 65 is in a maximum upward position; conversely, when the lever or handle 64''' is in rotated 180° about its pivotal axis, then the rod 65 will be in its lowermost position.

Referring to FIG. 5, the rod 65 is shown to be connected to a hollow, cylindrical can pusher 66 which is rotatably attached to the lower end of rod 65; positioned within pusher 66 is a spring means 68 which tends to bias 66 downwardly, the top end of the spring 68 being abutted against a surface 66' within 66. The lower surface of 66 as identified by reference numeral 66".

Operation

Upon start-up, the petcock 62' is opened; the tubes 52AA' and 63 are connected to a supply of fluid. The crank 83/84 is rotated to operate the pump so as to purge air out of the system.

An aerosol can AA is positioned with the spout 103 positioned within the female receiving means shown in FIG. 6, as the bottom surface 104 of spout 103 of the can engages the step 48I, the handle 64''' of the holding means is rotated so as to push rod 65 downwardly to thus push surface 66" of the pusher 66 against the bottom of the can all as is shown in FIG. 1. The downward pressure on the can AA results in the spout 103 (end 104 thereof being in contact with step 48I) being pushed upwardly into can AA so as to permit the passage of fluid from the pump means into the can. The operator of the machine then rotates the crank to pump fluid into the supply passage 51 of manifold 50, through first bore 24, third bore 36 and second bore 26 to the extent permitted by the setting of the pressure regulator means in the second bore. Importantly at this time, the aforesaid pressure in the third bore is transmitted up through pipe 46 to the receiving means shown in FIG. 6, more specifically, the fluid flows through pipe 46, bore 48G, bore 48H and into the can AA through the spout 103.

The pressure regulating means in the second bore are set to establish a limit on the pressure available for filling the can. The pressure is measured and indicated by a pressure figuring/indicating means 39 connected by fittings 37 and 38 which are connected to a threaded opening 36C of the third bore 36 as shown in FIG. 4.

The operator typically continues turning the crank until the pressure gauge reaches a preselected indication; this indicate the appropriate amount of fluid having been transferred into the can AA. The operator then stops rotating the crank; the filled can AA is removed and, if desired, another empty can be put into position and held by the holding as aforesaid for filling. In FIG. 1, the rotation of crank 83 is shown as clockwise. However, it will be understood that the pump 70 will also operate just as effectively with counter-clockwise rotation of crank 83.1

FIGS. 9 and 10 have been provided to show an arrangement for filling an aerosol can that has a female-type or internal valve means. Those skilled in the art will understand that the arrangements shown in FIGS. 9 and 10 respectively, tend to have a reverse functionality of the apparatus shown in FIGS. 6 and 6A.

I claim:

1. A portable, manually operated apparatus for filling fluid into a pressurized fluid container having a check valve port means for discharging fluid under pressure when selectively actuated, said filling apparatus comprising:

a) a base member having first and second spaced-apart bores and a third bore at an angle to and connecting said first and second bores;

b) manifold means having fluid supply and return passages therein (i) connected to said base member, and (ii) with said supply and return passages respectively connected to said first and second bores;

c) fluid pump means (i) adapted to be connected to a supply of fluid, and (ii) connected to said manifold means fluid supply and return passages and adapted, when actuated, to supply fluid under pressure to said fluid supply passage; and d) receiving means connected to said base member and adapted to receive said port means of said fluid container, said receiving means further being connected to said third bore of said base member.

2. Apparatus of claim 1 further characterized by said fluid pump means including means for manual actuation.

3. Apparatus of claim 2 including said fluid pump means having a rotary drive shaft and a manually operable crank means for rotating said shaft.

4. Apparatus of claim 3 further characterized by said fluid pump means being connected to said manifold means.

5. Apparatus of claim 1 further characterized by said receiving means further including means, which in combination with said container check valve port means, causes the opening of said check valve port means upon the insertion of said container check valve port means into said receiving means so as to thereby permit fluid to flow into said container.

6. Apparatus of claim 5 including means for selectively controlling the pressure of the fluid transferred to said container.

7. Apparatus of claim 6 wherein said selective pressure control means includes a pressure regulator means positioned in said second bore.

8. Apparatus of claim 7 wherein said pressure regulator means includes (i) a piston having a head with a spring receiving surface and a pressure face at one end and a valve element at a second end, (ii) a valve seat in said second bore adapted to receive said valve element, and (iii) adjustable spring bias means connected to said spring receiving surface of said head of said piston.

9. Apparatus of claim 8 characterized by said fluid being recirculated through said supply passage, through said first, second and third bores, to said return passage and thence to said fluid pump means.

10. Apparatus of claim 9 including pressure indicator means connected to measure and indicate fluid pressure in said third bore.

11. Apparatus of claim 1 including pressure indicator means connected to measure and indicate fluid pressure in said third bore.

12. Apparatus of claim 1 including means for connecting said return passage to a supply of fluid.

13. Apparatus of claim 1 further including check valve means positioned in said first bore and adapted to prevent back-flow of fluid from said first bore to said supply passage.

14. Apparatus of claim 1 wherein said receiving means includes female means adapted to receive a male type port on said fluid container.

15. Apparatus of claim 1 wherein said receiving means wherein said receiving means includes male means adapted to be received by a female-type port on said fluid container.

16. Apparatus of claim 1 wherein said receiving means includes excess fluid collection means.

17. Apparatus of claim 1 further characterized by said fluid pump means being attached to said manifold means.

18. A portable, manually operated apparatus for filling fluid into a aerosol fluid container having a check valve port means for discharging fluid under pressure when selectively actuated, said filling apparatus comprising:

a) a base member having first and second spaced-apart bores and a third bore at an angle to and connecting said first and second bores;

b) manifold means having fluid supply and return passages therein (i) connected to said base member, and (ii) with said supply and return passages respectively connected to said first and second bores;

c) fluid pump means (i) adapted to be connected to a supply of fluid, and (ii) connected to said manifold means fluid supply and return passages and adapted, when actuated, to supply fluid under pressure to said fluid supply passage;

d) receiving means connected to said base member and adapted to receive said port means of said fluid container, said receiving means further being connected to said third bore of said base member; and e) holding means for holding said fluid container in a position to facilitate said port means to be received by said receiving means.

19. Apparatus of claim 18 further characterized by said fluid pump means including hand crank means for manual actuation of said fluid pump.

20. Apparatus of claim 18 further characterized by said receiving means further including means, in combination with said container check valve port means, causes the opening of said check valve port means upon the insertion of said container check port means into said receiving means so as to thereby permit fluid to flow into said container.

21. Apparatus of claim 20 including means for selectively controlling the pressure of the fluid transferred to said container.

22. Apparatus of claim 21 wherein said selective pressure control means includes a pressure regulator means positioned in said second bore.

23. Apparatus of claim 22 including pressure indicator means connected to measure and indicate fluid pressure in said third bore.

24. Apparatus of claim 23 characterized by said fluid being recirculated through said supply passage, through said first, second and third bores, to said return passage and thence to said fluid pump means.

25. Apparatus of claim 22 further including check valve means positioned in said first bore and adapted to prevent back-flow of fluid from said first bore to said supply passage.

26. Apparatus of claim 18 wherein said receiving means includes female means adapted to receive a male type port on said fluid container.

27. Apparatus of claim 18 wherein said receiving means wherein said receiving means includes male means adapted to be received by a female-type port on said fluid container.

28. An apparatus for transferring fluid into a fluid container having port means for receiving fluid under pressure, said apparatus comprising:

a) a base member having first and second spaced-apart bores and a third bore at an angle to and connecting said first and second bores;

b) manifold means having fluid supply and return passages therein (i) connected to said base member, and (ii) with said supply and return passages respectively connected to said first and second bores;

c) fluid pump means (i) adapted to be connected to a supply of fluid, and (ii) connected to said manifold means fluid supply and return passages and adapted, when actuated, to supply fluid under pressure to said fluid supply passage; and d) fluid transfer means connected to said third bore means and to said port means of said fluid container.

29. Apparatus of claim 28 further characterized by said fluid pump means including hand crank means for manual actuation thereof of said fluid pump means.

30. Apparatus of claim 28 including means for selectively controlling the pressure of the fluid transferred to said container.

* * * * *